United States Patent [19]

Preuss et al.

[11] Patent Number: 4,678,873

[45] Date of Patent: Jul. 7, 1987

[54] LOW-VOLTAGE CIRCUIT BREAKER HAVING A SWITCHING MECHANISM ARRANGED IN A SEPARATE CHAMBER

[75] Inventors: Bernhard Preuss; Klaus-Gunther Berndt, both of Berlin, Fed. Rep. of Germany

[73] Assignee: Siemens Aktiengesellschaft, Munich, Fed. Rep. of Germany

[21] Appl. No.: 818,883

[22] Filed: Jan. 14, 1986

[30] Foreign Application Priority Data

Jan. 15, 1985 [DE] Fed. Rep. of Germany ..... 3501480

[51] Int. Cl.[4] ..... H01H 71/16

[52] U.S. Cl. ..... 200/18; 337/43; 200/307

[58] Field of Search ..... 361/343, 376; 335/35, 335/36; 337/42, 43, 45, 46, 48, 50; 200/18, 5 B, 50 C, 254, 294, 307, 330, 331, 336

[56] References Cited

U.S. PATENT DOCUMENTS

| | | | |
|---|---|---|---|
| 2,824,191 | 2/1953 | Christensen | 200/116 |
| 3,243,563 | 3/1966 | Gryciko | 200/168 |
| 3,840,833 | 10/1974 | Mrenna | 337/43 |

FOREIGN PATENT DOCUMENTS

| | | |
|---|---|---|
| 1101576 | 3/1961 | Fed. Rep. of Germany . |
| 2817668 | 3/1961 | Fed. Rep. of Germany . |
| 2157927 | 5/1973 | Fed. Rep. of Germany . |
| 2845950 | 4/1980 | Fed. Rep. of Germany . |
| 1140468 | 3/1957 | France . |
| 1527535 | 5/1968 | France . |
| 2105797 | 4/1972 | France . |
| 2246957 | 5/1975 | France . |

OTHER PUBLICATIONS

CAT.2-1, TN 2419, 11/68, SACE, Bergamo; Italy.

*Primary Examiner*—G. P. Tolin
*Attorney, Agent, or Firm*—Kenyon & Kenyon

[57] ABSTRACT

A low-voltage circuit breaker of compact design has a housing of insulating material with several parallel disposed chambers. A switching mechanism designed as a structural unit is provided in one of the chambers. The other chambers comprise compartments for switching path contacts. The switching mechanism comprises a U-shaped carrier for all moving parts. In particular, a drive shaft with a coupling part, such as a key, as well as a tripping shaft, likewise having a coupling part such as a slot, are provided. A pole control shaft is provided for actuating the switch contacts and is provided at its end with a coupling part such as a slot which comes into engagement with the coupling part of the drive shaft of the switching mechanism if the latter is built into the switch gear.

8 Claims, 6 Drawing Figures

LOW-VOLTAGE CIRCUIT BREAKER HAVING A SWITCHING MECHANISM ARRANGED IN A SEPARATE CHAMBER

BACKGROUND OF THE INVENTION

The present invention relates to a low-voltage circuit breaker of compact design having the following features:

(a) a housing of insulating material with several parallel chambers;

(b) electrical current paths and a switching mechanism with a control shaft provided in the chambers, the switching mechanism being arranged in a separate chamber; and (c) a carrier for supporting the components of the switching mechanism.

A low-voltage circuit breaker of this type has become known through the company publication CAT 2-1 TN 2419 (11/1968) of the firm Sace, Bergamo, Italy. In such a switch, the chambers containing the current paths are free of components of the switching mechanism (except for the control shaft connecting them), which is advantageous for the design of the contact-making element and has a favorable effect on achieving a large switching capacity. However, increased expenditures result for the incorporation of the lateral switching mechanism and its coupling to the tripping organs of the switch.

In a further circuit breaker which has become known from U.S. Pat. No. 3,243,563, the switching mechanism comprises a frame which is fastened to the bottom of the breaker housing. The control shaft and the tripping shaft extend over all chambers of the housing. Here, too, difficulties are encountered in connecting all components to the control shaft or the tripping shaft.

SUMMARY OF THE INVENTION

It is therefore an object of the present invention to design a switching mechanism which can be arranged in a separate chamber in such a manner that it can be inserted into a switching device as a structural unit.

This problem is solved in a low-voltage circuit breaker of the type mentioned above having the following additional features:

(a) the carrier is designed as a one-piece U-shaped part with cutouts for fastening means provided at its central part;

(b) the control shaft has a drive shaft on the switching mechanism side and a pole control shaft coupling the drive shaft to the current paths; and (c) the pole control shaft and the drive shaft on the side of the switching mechanism are designed at their ends facing each other as coupling parts cooperating in a form-locking manner.

The separation of the control shaft into a pole control shaft and a drive shaft on the switching mechanism side allows the switching mechanism and the contact apparatus of the switch to be assembled independently of each other. The coupling parts provided make possible not only the subsequent assembly of the switching mechanism as a unit, but also lead to a certain amount of compensation of alignment errors and tolerances, so that disturbances of the operation of the switch due to different properties of the bearings of the control shaft in the region of the switching mechanism and the current paths are avoided. The U-shaped carrier then assures a design of the switch mechanism which can be mounted equally well, is easy to check and convenient to insert into the switching device.

The cutouts provided in the central part of the U-shaped carrier permit the insertion of the fastening means from the base surface of the switch gear, i.e., in the same direction in which customarily further components of the switch are fastened.

According to a further embodiment of the invention, engagement of the drive shaft on the switch mechanism side with the pole control shaft, which can be brought about particularly simply, can be achieved by such a design of the coupling parts that the latter come into engagement in the event of a shift of the drive shaft and the pole control shaft by a design of the coupling parts such that they come into engagement in the event of a shift of the drive shaft and the pole control shaft with parallel longitudinal axes in the off position. For this purpose, particularly the end faces of the drive shaft and the pole control shaft on the switching mechanism side are provided with coupling parts in the manner of slot and key, where the lengthwise dimension of these coupling parts in the off position corresponds to the direction of motion of the carrier when the switching mechansm is inserted into the housing. Thereby, a tolerance compensation in the direction of the longitudinal axis of the shafts is provided very simply. According to experience, it is possible in addition to compensate small angle errors with appropriate design of the coupling parts.

Joints with similar action are known per se in switches with individual pole housings (See, e.g., U.S. Pat. No 2,824,191).

In a further embodiment of the invention it is possible to bring automatically into engagement a tripping shaft of the switching mechanism with a tripping device mounted independently of the carrier of the switching mechanism. For this purpose, coupling parts are suitable which are designed in principle similar to the coupling parts provided for the control shaft.

In addition, the number of the current paths of a switch can be increased in a surprisingly simple manner by providing the drive shaft on the side of the switching mechanism at both ends with a coupling part for a pole control shaft. In this case, the pole control shaft of a separate switching pole can be coupled to the free end of the drive shaft so that, for instance, a normal three-pole switching device can be converted into a four-pole switching device. Such a supplementation of a normal three-pole switching device by a fourth pole can be made by the provision that the housing of the switch on the side of the switching mechanism facing away from the pole paths has a removable portion for providing access to the other end of the drive shaft of the switching mechanism, and that a single pole with a pole control shaft of its own can be added to the housing while at the same time being coupled to the drive shaft.

The drive shaft on the switching mechanism side has the purpose to pass on the driving power which is made available in a manner known per se, for instance, by a beyond-dead-point spring and a toggle lever, to the pole switching shaft as a rotary motion. This requires a good support of the drive shaft at the carrier of the switching mechanism, while at the same time, a coupling element in a position advantageous for engagement with the pole control shaft is to be provided. In principle, these requirements can be met by a drive shaft with a sufficiently large diameter, but then the bearing openings of the carrier have a correspondingly large diameter, which is not desirable for various reasons. In one embodiment of the invention, the carrier of the switching mechanism comprises a free-standing tab with a bearing opening and the drive shaft has a central shaft body with a leg which extends freely and serves for introducing a driving force, as well as a bridge-like extension provided for extending around the free end of the tab of the carrier as the connection of the shaft body with a rib or key serving as a coupling part, which, starting from the center of the shaft, is designed extending over approximately the height of the extension. As the support for the drive shaft, a simple cylindrical pin is sufficient in this design which engages the support opening of the free-standing tab. The bearing properties and the produceability of such an arrangement are favorable. The key serving as a coupler is furthermore given a position on the outside of the carrier where the engagement with a corresponding counterpiece of the pole control shaft does not cause problems. Such a drive shaft can be made in one piece of metal or plastic.

BRIEF DESCRIPTION OF THE DRAWINGS

The invention will be explained in greater detail in the following detailed description with reference to the drawings in which.

DETAILED DESCRIPTION

Figure 1:
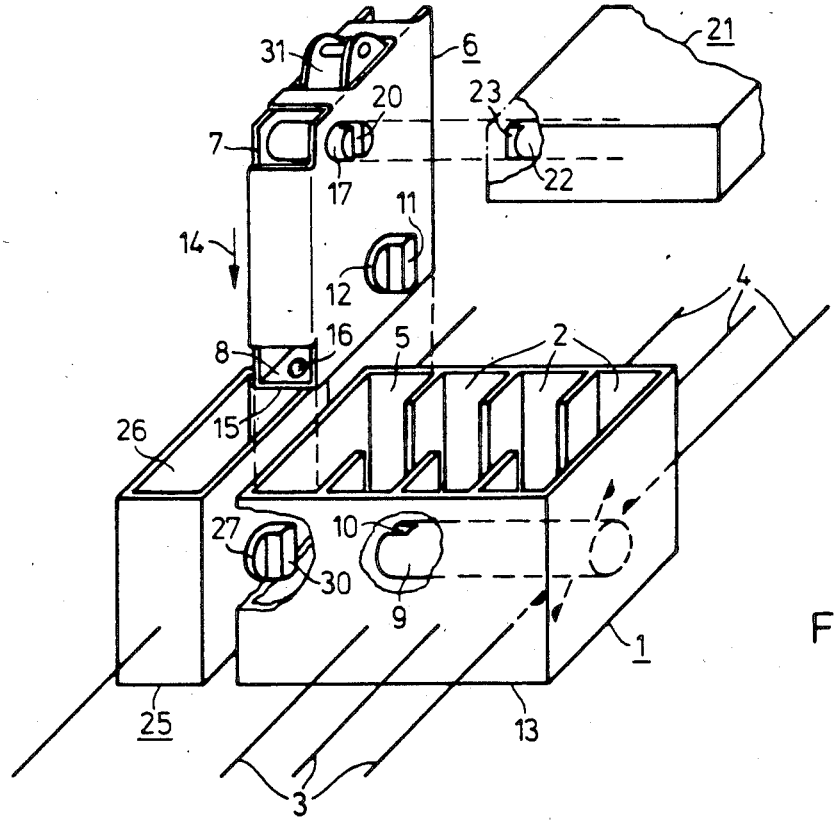
FIG. 1 shows a basic perspective view of a switch according to the invention.

With reference now to the drawings, in FIG. 1, parts of a low voltage circuit breaker of compact design are shown in perspective view. Simplifications were made in order to emphasize the basic features. The largest of the components shown is, as the basic body of the switch, a housing 1 of insulating material which comprises four chambers arranged side by side. Of these, the three chambers 2 disposed side by side are provided for receiving the contact apparatus of one current path each. These parts are shown only schematically in phantom in FIG. 1 and their connecting lines are indicated by the connecting lines 3 on the front side of the housing 1 or lines 4 on the back side thereof. The chamber 5 shown in FIG. 1 to the left next to the chambers 2 serves for accommodating the switching mechanism 6 which is shown as a structural unit above the chamber 5 prior to insertion. For simplification, the switching mechanism 6 is shown as a prismatic block, while a structural part designed in accordance with practical considerations can have an appearance deviating therefrom, as will be shown later with reference to the further figures. The switching mechanism 6 has a U-shaped carrier 7 with a central part 8.

In the housing 1, a pole control shaft 9 is rotatably supported, and is equipped with movable contacts in a manner not shown in detail, which in turn cooperates with fixed contacts, likewise not shown in detail. These may be one-arm or two-arm contact levers such as are generally known in the technology of switchgear. Examples therefor are shown in, among other references, DE-A 21 57 927 and DE-B-28 17 668. At its end face facing the chamber 5 of the housing body 1, the control shaft 9 is provided with a slot 10.

The latter can be engaged by a rib or key 11 on the end face of a drive shaft 12 of the switching mechanism 6. To this end, the position of the parts is chosen so that the slot 10 and the key 11 are aligned perpendicularly to the base surface 13 of the housing 1 if the pole control shaft 9 and the driving shaft 12 occupy a position corresponding to the "off" position of the breaker. The key 11 then comes into engagement with the slot 10 if the switching mechanism 6 is introduced into the chamber 5 of the housing 1 in the direction of the arrow 14. In this position, the switching mechanism 6 is connected to the housing 1 by suitable fastening means. For this purpose, one or more passage openings for fastening means are provided in the bottom surface 15 of the switching mechanism, for instance, tapped holes 16, with which screws can engage which are introduced from the bottom surface 13 of the housing 1.

The switching mechanism 6 further comprises a tripping shaft 17, the longitudinal axis of which extends approximately parallel to the longitudinal axis of the drive shaft 12 and therefore also to the bottom surface 13 of the housing 1. The free end of the tripping shaft 17 is similarly provided with a slot 20 as was explained before in connection with the pole control shaft 9. The tripping shaft 17 cooperates with a tripping device block 21, the tripping shaft 22 of which extends parallel to the base surface 13 of the housing 1 if the tripping device block is mounted in the switching device, for instance, resting on the housing 1. A coupling to the tripping shaft 17 of the switching mechanism 6 also is provided by a key 23 on the end face of the tripping shaft 22 of the tripping device block 21.

In FIG. 1 there is shown beside the housing 1 to the left, a further small housing 25 which comprises a single chamber 26 for a further current path corresponding to the current paths located in the chambers 2. In the housing 25 there is likewise a pole control shaft 27, the end face facing the switching mechanism 6 of which is provided with a key 30. By a slot of the driving shaft 12 which corresponds to the key 30 but which is not visible in FIG. 1, the additional current path can be coupled to the drive shaft 12, if the housing 25 is mounted to the housing 1 and is firmly connected thereto.

Not shown in FIG. 1 are a control handle for connection to the drive lever 31 of the switching mechanism 6 as well as a housing cover which covers the parts described from above. These parts can logically be designed in a manner known for switchgear of compact design with an insulating material housing.

As evident from the description above, it is immaterial for the principle of the invention whether the pole control shaft 9 and the drive shaft 12 are provided with the slot 10 or the key 11 or whether the reverse arrangement is chosen. In addition, also the form of the coupling parts can be modified at will, as long as it is assured that the coupling parts come into engagement if the switching mechanism 6 with its drive shaft 12 and the pole control shaft 9 are shifted parallel to each other.

The possibility of such modifications relates likewise to the design of the tripping shafts 17 and 22 as well as the pole control shaft 27 of the additional housing 25.

Figure 2:
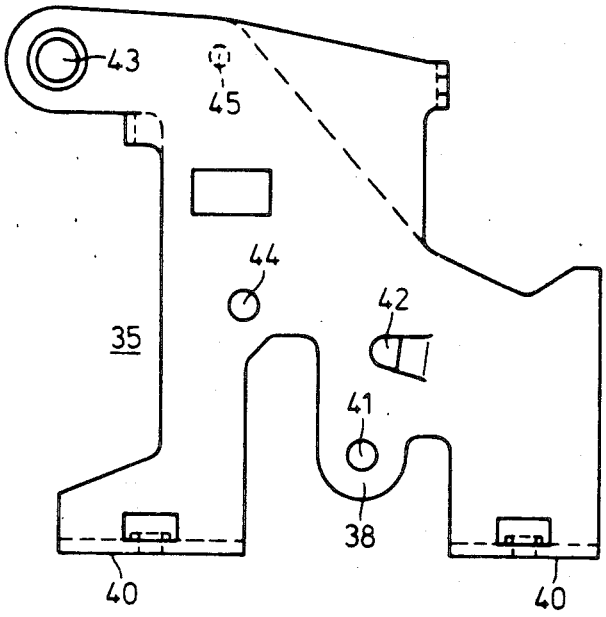
FIGS. 2 and 3 show a U-shaped carrier of a switching mechanism in two views.
Figure 3:
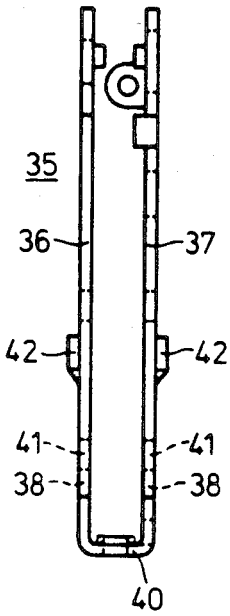

The switching mechanism 6 comprises a U-shaped carrier 35 as shown in more detail in FIGS. 2 and 3. The carrier 35 has two legs 36 and 37 which have the same length but different shapes and which are connected to each other by a central part 40. As shown in FIG. 3, the U-shape does not prevail all the way, but is interrupted in the middle by a region in which there are two free-standing tabs 38 with bearing openings 41 for a drive shaft still to be described. The legs 36 and 37 further have abutments 42 which are pushed out of the plane of the metal sheet, for the drive lever 31, the upper ends of which are indicated schematically in FIG. 1. For the rotatable support of the tripping shaft 17, the legs 36 and 37 are provided with further bearing openings 43. For the further components of the switching mechanisms, particularly a ratchet lever and an intermediate ratchet, the carrier 35 is provided with further bearing elements 44 and 45 of suitable dimensions and position. In this manner, the carrier 35 can accommmdate all parts of the switching mechanism. These parts can be arranged between the legs as well as extending beyond the legs.

The control shaft which is to be supported in the openings 41 of the legs 36 and 37 will now be explained, referring to FIGS. 4 and 5. As is shown in these figures, the drive shaft 50 is an integral part, which, however, is divided in accordance with several functions. From a central shaft body 51 extend two legs which are parallel to each other with a small spacing and point in the same direction but have different lengths. The shorter leg 52 of the drive shaft 50 serves for introducing a driving force and is provided for this purpose with an opening 53 for a joint pin which may, for instance, be in connection with a toggle lever system. The longer leg 54 serves for actuating an auxiliary switch which thus opens and closes contacts in dependence on the switch position. Onto the central shaft body 51 is formed a key 55 which forms a part of the above described coupling. As shown, the key 55 covers a bearing hole 56, into which a bearing pin which goes through the bearing openings 41 can be inserted. An extension 57 forms, so to speak, a bridge between the shaft body 51 and the key 55 so that in the assembled condition of the switching mechanism 6, the legs 52 and 54 of the drive shaft 50 lie between the legs 36 and 37 of the carrier 35, while the key 55 is accessible from the outside of the carrier 35.

The extension 57 extends over the rounded free end of the one tab 38. Due to the asymmetrical position of the key 55, starting from the center, with respect to the axis of rotation of the drive shaft 50, a relatively large lever arm is obtained and thereby, a secure transmission of the torque.

Figure 4:
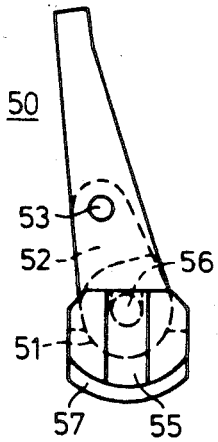
FIGS. 4 and 5 show a drive shaft on the switching mechanism side in two views.
Figure 5:
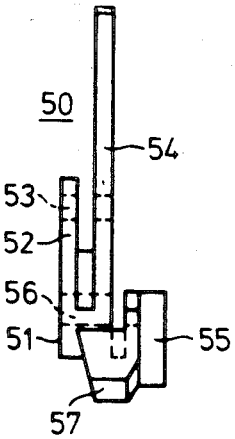

The drive shaft 50 can be made, according to FIGS. 4 and 5, as a one-piece part of metal or a plastic of suitable strength. The drive shaft 50 can also be provided with a key 55 on both sides so that pole control shafts can be coupled on both sides, as explained above.

Figure 6:
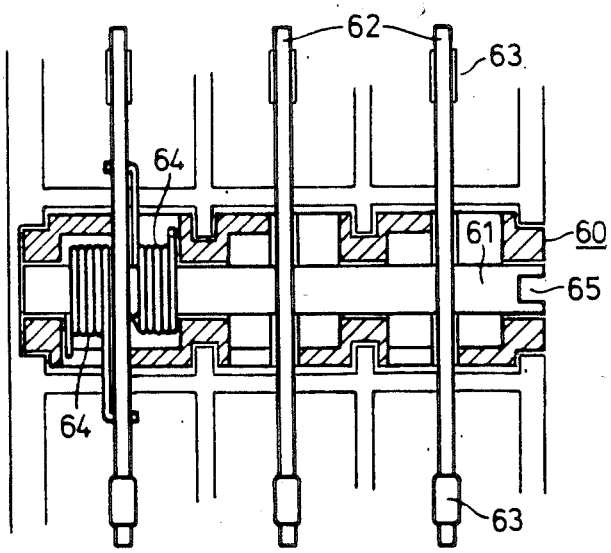
FIG. 6 shows a pole control shaft.

Referring to FIG. 6, an embodiment of a pole control shaft is illustrated which is shown schematically in FIG. 1 and is designated with 9. The pole control shaft 60 is a hollow body with an axial length corresponding to the number of switch contacts to be actuated. On an insulated inner shaft section 61, double contact levers 62 are pivoted which are provided at their ends with contact overlays 63. These contact overlays cooperate with mating contacts which are arranged in the housing of the switch in a stationary manner. With each of the double contact levers 62 are associated two torsion springs 64 in such a manner that a pretension relative to the control shaft 60 exists. If the control shaft 60 is actuated, the double contact levers 62 are taken along until their contact overlays 63 make contact with the mating contacts, not shown. Upon further rotation of the control shaft 60, the torsion springs 64 are cocked to supply the required contact force. To initiate a rotary motion for switching on and off, a slot 65 is arranged which cooperates with the key 55 of the drive shaft 50 (FIGS. 4 and 5) at the end face at one end of the control shaft 60 in a way which was explained in principle with reference to FIG. 1.

As shown, secure coupling of the drive shaft to the pole control shaft can be obtained also with a design that deviates from the examples illustrated in the manner of a slot-and-key coupling. For instance, several keys and slots can engage or the mutually opposite ends of the shafts to be coupled can be given a shape deviating from the shaft part in order to bring about a low specific stress by enlarging the coupling areas.

In the foregoing specification, the invention has been described with reference to a specific exemplary embodiment thereof. It will, however, be evident that various modifications and changes may be made thereunto without departing from the broader spirit and scope of the invention as set forth in the appended claims. The specification and drawings are, accordingly, to be regarded in an illustrative rather than a restrictive sense.

What is claimed is:

1. A low-voltage circuit breaker comprising:

housing means of insulating material having a plurality of parallel disposed chambers, contact means for electrical current being provided in all but one of said chambers, switching mechanism means for operating the contact means being arranged in the remaining chamber, a control shaft coupling the switching mechanism means and each of the contact means, said control shaft means being provided for operating the contact means;

carrier means supporting said switching mechanism means, said carrier means comprising a one-piece U-shaped part having cutouts for fastening means provided in a central part thereof;

said control shaft comprising a pole control shaft coupled to the contact means and a drive shaft extending from one side of the switching mechanism means;

the pole control shaft and said drive shaft of the switching mechanism means having adjacent ends thereof facing each other provided with coupling parts cooperating in a form-locking manner.

2. The low-voltage circuit breaker recited in claim 1, wherein the coupling parts provide said form-locking engagement even if there is a shift of the drive shaft and the pole control shaft in opposite directions in the "off" position of the circuit breaker along longitudinal axes of said drive shaft and pole control shaft.

3. The low-voltage circuit breaker recited in claim 2, wherein the ends of the drive shaft on said one side of the switching mechanism means and of the pole control shaft are provided with coupling parts comprising a slot and key, the longitudinal extent of these coupling parts in the "off" position of the circuit breaker corresponding to a direction of motion of the carrier means when the switching mechanism means is installed in the housing means.

4. The low-voltage circuit breaker recited in claim 1, wherein the switching mechanism means comprises a tripping shaft and further comprising tripping means mounted independently of the carrier means of the switching mechanism means adjacent said housing means which can be brought into engagement automatically with the tripping shaft of said switching mechanism means when the switching mechanism means is installed in the housing means.

5. The low-voltage circuit breaker recited in claim 1, wherein the drive shaft of the switching mechanism means is provided at both ends thereof with a coupling part cooperating with a mating part of a pole control shaft.

6. The low-voltage circuit breaker recited in claim 5, wherein the housing means comprises, on a side facing away from and adjacent the switching mechanism means, a removable portion for providing access to the drive shaft of the switching mechanism means, a single-pole housing means having a further pole control shaft being coupled to the housing means while simultaneously being coupled to the drive shaft.

7. The low-voltage circuit breaker recited in claim 1, wherein the carrier means has a free-standing tab having a bearing opening, the drive shaft having a central shaft body with a leg extending therefrom and serving for coupling a driving force to the switching mechanism means, a bridge-like extension extending over the free end of the tab of the carrier means and connecting the shaft body with a key which serves as a coupling part, said key starting from approximately the center of said shaft body and extending for approximately the length of the extension in a direction substantially along the longitudinal direction of said leg.

8. The low voltage circuit breaker recited in claim 1, wherein the coupling parts provide said form locking engagement when said switching mechanism means is inserted into said housing means, said coupling means each having longitudinal extents in the "off" position in a direction of motion of the carrier means when the switching mechanism means is installed in the housing means.

* * * * *